US009308635B2

(12) United States Patent
Moore

(10) Patent No.: US 9,308,635 B2
(45) Date of Patent: Apr. 12, 2016

(54) VARIABLE VOLUME ACCUMULATOR

(71) Applicant: Caterpillar Inc., Peoria, IL (US)

(72) Inventor: Cody Moore, Waco, TX (US)

(73) Assignee: Caterpillar Inc., Peoria, IL (US)

( * ) Notice: Subject to any disclaimer, the term of this patent is extended or adjusted under 35 U.S.C. 154(b) by 586 days.

(21) Appl. No.: 13/751,315

(22) Filed: Jan. 28, 2013

(65) Prior Publication Data

US 2014/0209340 A1 Jul. 31, 2014

(51) Int. Cl.
*B25D 9/14* (2006.01)
*B25D 9/12* (2006.01)
*B25D 9/26* (2006.01)

(52) U.S. Cl.
CPC *B25D 9/145* (2013.01); *B25D 9/26* (2013.01); *B25D 2209/002* (2013.01)

(58) Field of Classification Search
CPC ..... B25D 9/14; B25D 9/145; B25D 9/12; B25D 9/26; B25D 2209/002
USPC ..... 173/200, 204, 112
See application file for complete search history.

(56) References Cited

U.S. PATENT DOCUMENTS

| | | | | |
|---|---|---|---|---|
| 4,676,323 | A * | 6/1987 | Henriksson | 173/200 |
| 5,064,005 | A | 11/1991 | Krone | |
| 5,890,548 | A | 4/1999 | Juvonen | |
| 6,155,353 | A | 12/2000 | Ottestad | |

FOREIGN PATENT DOCUMENTS

| | | |
|---|---|---|
| EP | 0587079 A2 | 9/1993 |
| JP | 08197456 | 8/1996 |
| WO | 2012030272 | 3/2012 |

* cited by examiner

*Primary Examiner* — Michelle Lopez
(74) *Attorney, Agent, or Firm* — Leydig, Voit & Mayer, Ltd.

(57) ABSTRACT

A hammer assembly including a hammer housing and a work tool movably supported in the hammer housing is provided. A gas chamber is defined in the hammer housing and contains a compressible gas. An accumulator assembly includes an interior space. A barrier divides the interior space into a first interior portion containing a compressible gas and a second interior portion configured to receive a pressurized fluid. The barrier is configured to be movable in response to changing the amount of pressurized fluid in the second interior portion and such that movement of the barrier varies the volume of the first interior portion. The first interior portion is in communication with the gas chamber. A control valve assembly is configured for selectively placing the second interior portion of the accumulator assembly in communication with a pressurized fluid source.

14 Claims, 3 Drawing Sheets

VARIABLE VOLUME ACCUMULATOR

TECHNICAL FIELD

This patent disclosure relates generally to accumulators and, more particularly to accumulators having a volume which is variable.

BACKGROUND

Hydraulic hammers are used on work sites to break up large hard objects before such objects can be moved away. Hydraulic hammers may be mounted to back hoes or excavators or other machines. Typically, the hammer assembly is powered by either a hydraulic or pneumatic pressure source or a combination of both. With those hammer assemblies powered by a combination of hydraulic and pneumatic pressure, a piston is retracted against a volume of compressible gas by applying a hydraulic fluid pressure to a first shoulder of a piston. As the piston retracts, the volume of gas decreases, increasing its pressure. Once the piston reaches a predetermined position, high pressure hydraulic fluid is applied to a second shoulder of a piston that drives the piston in a downward direction for a work or power stroke. The downward movement of the piston allows the compressed gas to expand, releasing energy which further propels the downward movement of the piston. During the power stroke, the downward moving piston strikes a work tool, which, in turn, is driven in the downward direction. The work tool strikes the object to be broken up.

Hydraulic hammers may be used to break-up a variety of materials such as rock, concrete, asphalt, or other hard objects. The physical properties of these materials can vary. For example, some materials may be harder than others. Harder materials typically require higher impact energy to fracture. One way to deal with this issue may be to use the hammer for a longer period of time on such materials. Another may be to switch to larger, more powerful hammers when encountering harder materials. However, both of these methods are inefficient and time-consuming. Moreover, while some hydraulic hammers have external, manual adjustments that can be used to shorten the length of the piston stroke, such adjustments do not allow for any increase in impact energy. To the contrary, while shortening the length of the piston stroke increases the frequency of the hammering, it decreases the impact energy produced by each stroke of the piston. Additionally, increasing the charging pressure of the compressible gas chamber in order to increase the impact energy produced by the hammer may undesirably shorten the life of the seals associated with the gas chamber as higher gas pressures are generally harder on the seals.

SUMMARY

The disclosure describes, in one aspect, a hammer assembly including a hammer housing and a work tool movably supported in the hammer housing. A gas chamber is defined in the hammer housing and contains a compressible gas. An accumulator assembly includes an interior space. A barrier divides the interior space into a first interior portion containing a compressible gas and a second interior portion configured to receive a pressurized fluid. The barrier is configured to be movable in response to changing the amount of pressurized fluid in the second interior portion and such that movement of the barrier varies the volume of the first interior portion. The first interior portion is in communication with the gas chamber. A control valve assembly is configured for selectively placing the second interior portion of the accumulator assembly in communication with a pressurized fluid source. A piston is movably disposed in the housing. The piston has a first fluid engagement surface configured for engagement with a pressurized fluid for moving the piston in a first direction away from the work tool and thereby compressing the compressible gas in the gas chamber and in the first interior portion of the accumulator assembly and producing a biasing force on the piston acting in a second direction towards the work tool. The piston has a second fluid engagement surface configured for engagement with a pressurized fluid for moving the piston in the second direction along with the biasing force.

The disclosure describes in another aspect a hammer assembly including a hammer housing and a work tool movably supported in the hammer housing. A gas chamber is defined in the hammer housing and contains a compressible gas. An accumulator assembly include an interior space. A barrier divides the interior space into a first interior portion containing a compressible gas and a second interior portion configured to receive a pressurized fluid. The barrier is configured to be movable in response to changing the amount of pressurized fluid in the second interior portion and such that movement of the barrier varies the volume of the first interior portion. The first interior portion is in communication with the gas chamber. A piston is movably disposed in the housing. The piston is movable in a first direction away from the work tool to thereby compress the compressible gas in the gas chamber and in the first interior portion of the accumulator assembly producing a biasing force on the piston acting in a second direction towards the work tool. The piston is movable in the second direction, at least in part, in response to the biasing force.

The disclosure describes in another aspect an accumulator assembly including a housing defining an interior space. A barrier is supported on the housing and divides the interior space into a first portion interior portion containing a compressible gas and a second interior portion configured to be in communication with a pressurized fluid. The barrier is configured to be movable in response to changing the amount of pressurized fluid in the second interior portion of the interior space such that movement of the barrier varies the volume of the first interior portion. The first interior portion is in communication with a fluid system such that an increase in pressure of the fluid system compresses the compressible gas in the first interior portion increasing the pressure thereof.

DETAILED DESCRIPTION

Figure 1:
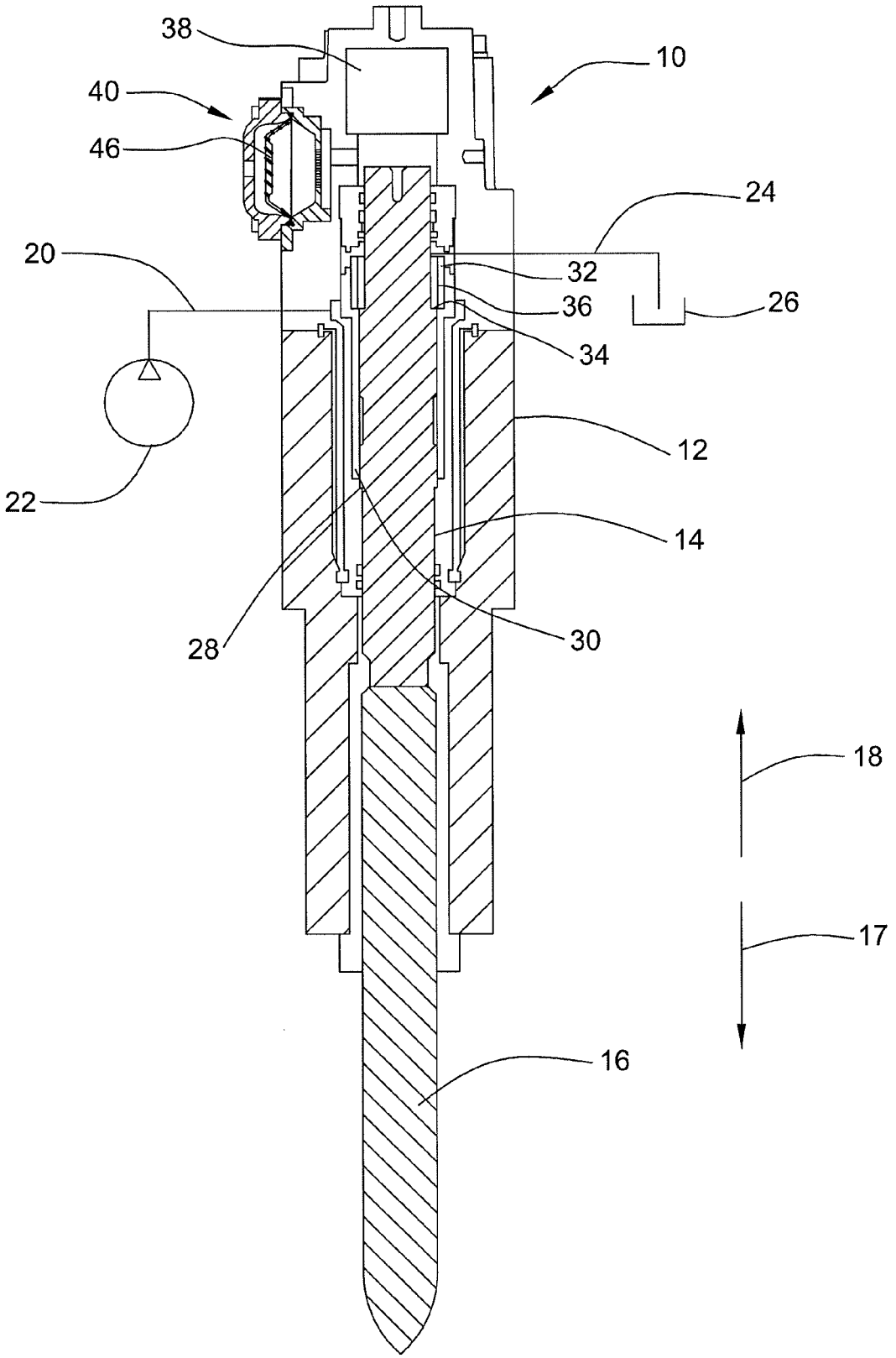
FIG. 1 is a schematic side sectional view of a hammer assembly according to the present disclosure.

This disclosure relates to an accumulator assembly having a volume that can be varied in order to adjust the effective volume of a compressed gas system with which the accumulator assembly communicates. With particular reference to FIG. 1 of the drawings, a cross-sectional view of an exemplary hammer assembly 10 is provided. In a known manner, the hammer assembly 10 may be attached to any suitable machine such as an excavator, backhoe loader, skid steer or similar machine. While the accumulator assembly is illustrated and described in connection with a hammer assembly, the accumulator assembly has applicability in various other types of machines as well. For example, the accumulator assembly may be used in any application involving a fluid system that is subject to pressure.

As shown in FIG. 1, the hammer assembly 10 may include a housing 12 within which a piston 14 may be slidably supported. Additionally, a work tool 16 may be supported in a lower end of the housing 12 with a portion of the work tool 16 extending outward therefrom. The work tool 16 may have any configuration, such as for example a chisel, that would be useful in hammering application. The work tool 16 also may be configured so as to be removable so as to allow a variety of tools with different configurations to be attached to the hammer assembly 10.

The piston 14 may be supported so as to be movable relative to the housing 12 in a reciprocating manner generally in the direction of arrows 17 and 18 in FIG. 1. More specifically, during an impact or work stroke, the piston 14 moves in the general direction of arrow 17 and near the end of the work stroke comes into contact with the work tool 16 such as shown in FIG. 1. Conversely, during a return stroke, the piston 14 retracts away from contact with the work tool 16 (the position shown in FIG. 1) in the general direction of arrow 18. The reciprocating impacts of the piston 14 on the work tool 16, in turn, drive a corresponding reciprocating movement of the work tool 16. When the piston 14 strikes the work tool 16, the force of the piston 14 is transmitted to the work tool 16 in the general direction of arrow 17. This force may be applied to a hard object such as rock, concrete or asphalt in order to break up the object.

The reciprocating movement of the piston 14 may be driven, at least in part, by pressurized fluid, such as pressurized hydraulic fluid. To this end, the hammer assembly 10 may include a high pressure inlet 20 which is coupled to or in communication with a high pressure source, such as a hydraulic pump 22, and an outlet 24 which is coupled to or in communication with a low pressure such as a reservoir or tank 26 (both the inlet 20 and outlet 24 are shown schematically in FIG. 1). The pump 22 and tank 26 may be provided by connecting the hammer assembly 10 to the hydraulic system of the carrier machine to which it is attached.

For moving the piston 14 in a first or upward direction away from the work tool (i.e., in the direction of arrow 18), the piston 14 may include a first or upward fluid engagement surface 28 that may be exposed to fluid pressure in a first fluid chamber 30 that is defined in the housing 12. The upward engagement surface 28 may be in the form of an annular shoulder provided in the surface of the piston 14 and may be configured or oriented for moving the piston 14 in the direction of arrow 18 away from the work tool 16. For moving the piston 14 in a second or downward direction towards the work tool 16 (i.e., in the direction of arrow 17), the piston 14 may further include a second or downward fluid engagement surface 32 that may be exposed to fluid pressure in a second fluid chamber 34. In this case, the downward fluid engagement surface 32 is arranged above the upward fluid engagement surface 28 on the piston 14 and also is in the form of an annular shoulder in the surface of the piston 14. The downward fluid engagement surface 32 may be configured with a larger effective surface area than the upward fluid engagement surface 28 such that the piston 14 is driven downward in the general direction of arrow 17 when both the first and second fluid chambers 30, 34 are in communication with the high pressure inlet 20. When only the first fluid chamber 30 is in communication with the high pressure inlet 28, high pressure fluid only acts on the upward engagement surface 28 and the piston 14 is driven upward.

A control valve assembly 36 may be provided that selectively connects the second fluid chamber 34 with either the high pressure inlet 20 or the low pressure outlet 24. The control valve assembly 36 may be configured such that movement of the piston 14 switches the control valve assembly 36 between connecting the second fluid chamber 34 with the high pressure inlet 20 and the low pressure outlet 24. In particular, the control valve assembly 36 may be configured such that when the piston 14 reaches a predetermined point in its upward return stroke, the control valve assembly 36 moves, such as in response to the application of a pilot pressure, to connect the second fluid chamber 34 with the pump 22. The engagement of the high pressure fluid in the second fluid chamber 34 with the downward fluid engagement surface 32 stops the upward return stroke of the piston 14 and helps start the downward work stroke of the piston 14. Likewise, the control valve assembly 36 may be configured such that when the piston 14 reaches a predetermined point in its downward work stroke, the second fluid chamber 34 is connected to the tank 26 causing the high pressure fluid to vacate the second fluid chamber 34. This permits the piston 14 to begin its upward return stroke again in response to fluid pressure in the first fluid chamber 30 acting on the upward fluid engagement surface 28.

While a particular pressurized fluid system has been described, those skilled in the art will appreciate that the present disclosure is not limited to any particular pressurized fluid system and that any suitable arrangement capable of driving upward and downward reciprocating movement of the piston may be used.

To generate a further downward force on the piston 14 for the work stroke, a gas chamber 38 may be provided in an upper portion of the housing 12 and into which an upper portion of the piston 14 extends. The gas chamber 38 may be charged with a trapped pressurized gas, such as nitrogen, that is compressible. The gas chamber 38 and piston 14 may be configured and arranged such that when the piston 14 retracts into the gas chamber 38 during its return stroke the piston 14 reduces the effective volume of the gas chamber 38 thereby compressing the gas. This increases the pressure of the gas in the gas chamber 38 and produces a downward biasing force on the upper end surface of the piston 14. The downward biasing force on the piston increases the further the piston 14 is retracted into the gas chamber 38. When the second fluid chamber 34 is connected to the pump 22 initiating the downward work stroke of the piston 14, the biasing force from the compressed gas in the gas chamber 38 combines with the downward force from the high pressure fluid acting on the downward engagement surface 32 to drive the piston 14 downward and into engagement with the work tool 16.

For selectively and variably increasing or decreasing the downward biasing force on the piston 14 produced by the gas chamber 38, a variable volume accumulator assembly 40 may be provided. The accumulator assembly 40 may include a housing 42 that defines an interior space 44 which may be divided by a barrier 46 into a first interior portion 48 containing a compressible gas and a second interior portion 50 that may receive a pressurized fluid, such as hydraulic fluid from the hydraulic system of the carrier machine, or otherwise be incompressible. The accumulator assembly 40 may be arranged and configured such that the first interior portion 48 of the accumulator assembly 40 is in communication with the interior of the gas chamber 38. More particularly, in the illustrated embodiment, the accumulator assembly 40 may be arranged on a side of the housing 12 of the hammer assembly 10 and with the first interior portion 48 of the accumulator assembly 40 being in communication with the interior of the gas chamber 38 via a fluid passageway 52. Thus, the first interior portion 48 of the accumulator assembly 40 effectively shares the volume of compressible gas with the gas chamber 38. While not present in the illustrated embodiment, an intermediate gas or fluid permeable barrier could be provided between the interior of the gas chamber 38 and the first interior portion 48 of the accumulator assembly 40. Additionally, while the illustrated embodiment has an accumulator assembly 40 that is mounted remotely from the gas chamber 38, the accumulator assembly 40 could be mounted directly to or integrated into the gas chamber 38 such that the accumulator assembly 40 and gas chamber 38 share the same housing.

Figure 2:
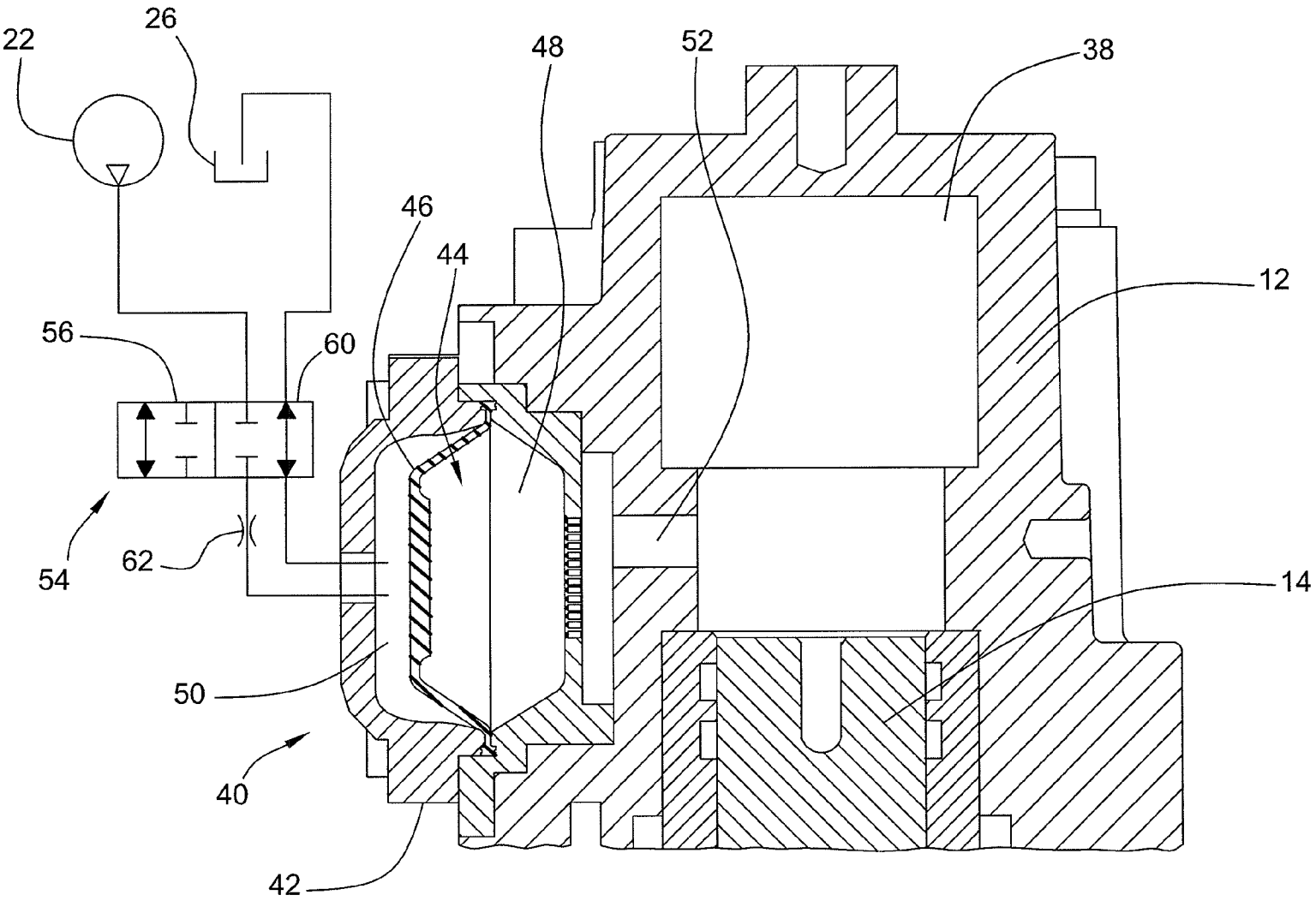
FIG. 2 is an enlarged, schematic side sectional view of the hammer assembly of FIG. 1 showing the accumulator assembly with the movable barrier positioned so as to define a relatively larger volume for receiving pressurized gas as compared to the position shown in FIG. 3.
Figure 3:
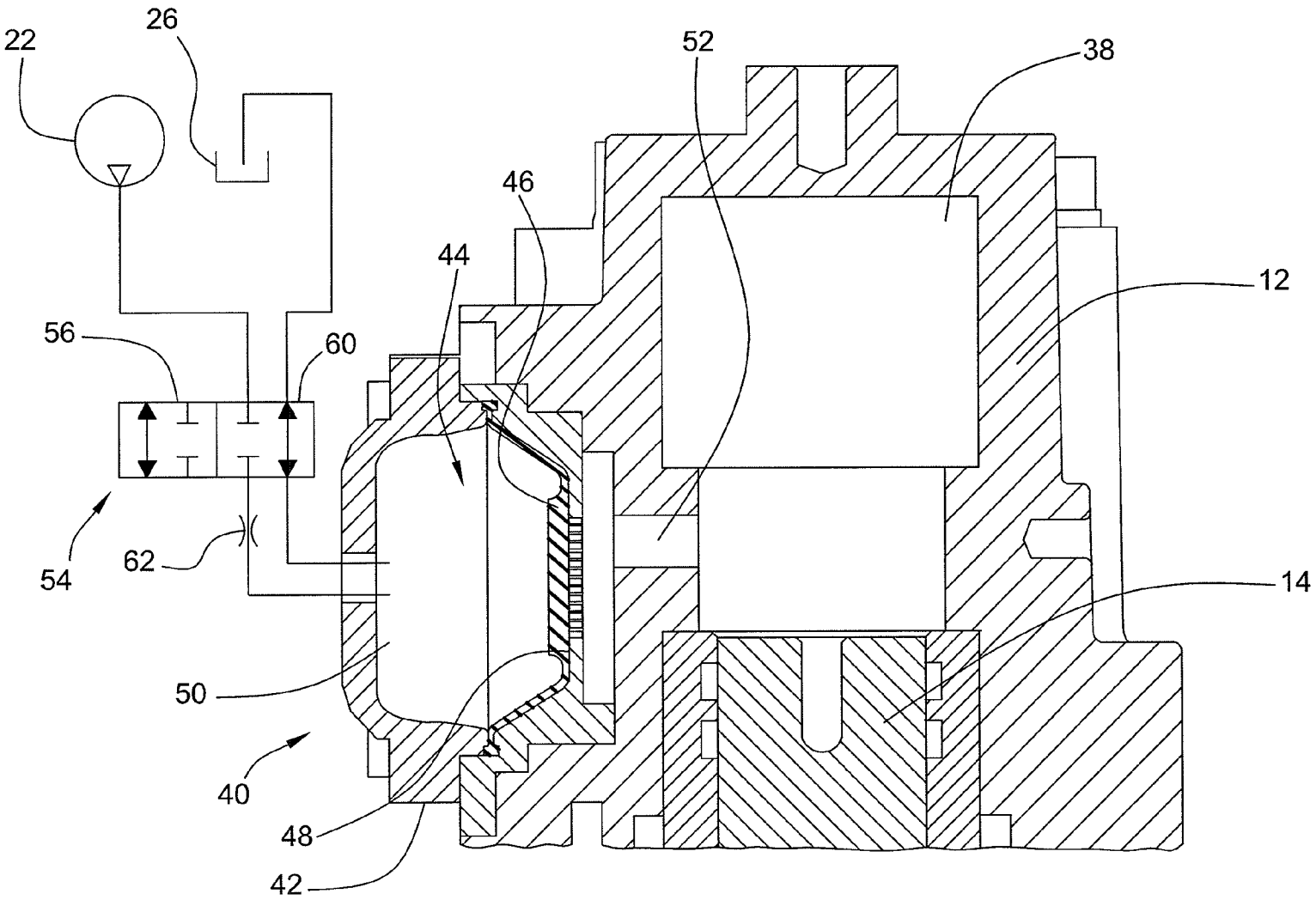
FIG. 3 is an enlarged, schematic side sectional view of the hammer assembly of FIG. 1 showing the accumulator assembly with the movable barrier positioned so as to define a relatively smaller volume for receiving pressurized gas as compared to the position shown in FIG. 2.

To allow the volume of the first interior portion 48 of the accumulator assembly 40 to be selectively varied, the barrier 46 dividing the interior space 44 may be movable. For example, the barrier 46 may be configured to move in response to changing the amount of pressurized fluid in the second interior portion 50 of the accumulator assembly 40. As more pressurized fluid is added to the second interior portion 50, the barrier 46 will move to accommodate the additional fluid thereby shrinking the volume of the first interior portion 48. Likewise, removing pressurized fluid from the second interior portion 50 will cause the barrier 46 to move back thereby expanding the volume of the first interior portion 48. In this regard, the barrier 46 may be made of an elastically deformable material, such as a rubber membrane or the like. In FIG. 2, the barrier 46 is arranged such that the second interior portion 50 is maximized and the first interior portion 48 is minimized or non-existent. In this position, the second interior portion 50 takes up all or nearly all of the interior space 44 of the accumulator assembly 40. In FIG. 3, the barrier 46 is arranged such that the second interior portion 50 is maximized and the first interior portion 48 is minimized or non-existent. In this position, the first interior portion 48 takes up all or nearly all of the interior space 44 of the accumulator assembly 40 such that the accumulator assembly provides very little to no space for receiving pressurized gas from the gas chamber 38.

It will be appreciated that the barrier 46 may be moved and the second interior portion 50 be made incompressible in manners other than by introducing pressurized fluid into the second interior portion 50. For example, the barrier 46 may be a rigid barrier that is movable by actuators that are configured to be capable of holding the rigid barrier steady against the forces generated by the increased pressures encountered in the first interior portion 48.

Because the first interior portion 48 of the accumulator assembly 40 is in communication with the interior of the gas chamber 38, moving the barrier 46 to reduce the volume of the first interior portion 48 (such as shown in FIG. 3) also reduces the effective volume available for the gas contained in the gas chamber 38. Reducing the volume of the first interior portion 48 of the accumulator assembly 40 increases the pressure of the gas in the gas chamber 38. Increasing the pressure of the gas in the gas chamber 38, in turn, increases the biasing force on the piston 14 that is produced by the compressed gas as the piston 14 is retracted into the gas chamber 38 during the upward return stroke of the piston 14. The result is an increased downward force on the piston 14 during the work stroke and an increased impact force on the work tool 16. Similarly, moving the barrier 46 to increase the size of the first interior portion 48 (such as shown in FIG. 2) provides the gas in the gas chamber 38 with additional volume into which it can expand, resulting in lower gas pressure and, in turn, smaller downward biasing forces on the piston 14. Using the example of the barrier 46 positions shown in FIGS. 2 and 3, the position shown in FIG. 3 would produce a relatively larger downward biasing force on the piston 14 than the barrier 46 position shown in FIG. 2. Thus, the impact force on the work tool 16 can be selectively varied by moving the barrier 46 in the accumulator assembly 40.

As shown in FIGS. 2 and 3, for controlling the flow of pressurized fluid into and out of the second interior portion 50 of the accumulator assembly 40, a control valve assembly 54 may be provided that is configured to selectively place the second interior portion 50 in communication with a pressurized fluid source, such as the hydraulic pump 22, and with low pressure fluid source, such as the tank 26. The high pressure source and the low pressure source may be provided using the hydraulic system on the machine carrying the hammer assembly 10 and may be the same as is used to power movement of the piston 14. The control valve assembly 54 may include a two-position control valve 56 having a first position 58 in which the second interior portion 50 of the accumulator assembly 40 is in communication with the pump 22 and isolated from the tank 26 in order to fill the second interior portion 50 with pressurized fluid and a second position 60 in which the second interior portion 50 is in communication with the tank 26 and isolated from the pump 22 in order to remove pressurized fluid from the second interior portion 50. The control valve 56 may be configured to move between the first and second positions 58, 60 in any suitable manner including, for example, hydraulically in response to a pilot pressure or electrically in response to a control signal from a controller.

Optionally, the control valve assembly 54 may be configured so as to regulate the rate at which the second interior portion 50 of the accumulator assembly 40 fills with pressurized fluid. For example, a flow restriction 62, such as a weephole, may be arranged in the line communicating with the pump 22 downstream of the control valve 56. The flow restriction 62 may allow the second interior portion 50 to be slowly filled with pressurized fluid, for example, over the course of a particular work cycle. This would enable the impact force produced by the hammer assembly 10 to slowly build during the course of the work cycle as a result of the slow build up in pressure in the gas chamber 38 caused by the gradual shrinking of the first interior portion 48 as the work cycle continues. This arrangement has the advantage that the increased impact force is only brought about when necessary such as when breaking apart harder objects. For example, if the object breaks apart instantly, the impact force will not have increased substantially because there would not have been sufficient time to fill the second interior portion 50 of the accumulator assembly with much hydraulic fluid. With harder objects, the impact energy will slowly build as the second interior portion 50 fills with pressurized fluid until the object is broken.

Depending on the flow and pressure ratings of the pump 22, the frequency of impacts produced by the hammer assembly 10 may decrease as the impact force increases due to providing more pressurized fluid to the second interior portion 50 of the accumulator assembly 40. However, the system could be configured such that this is not the case including by providing a pressurized fluid source with a relatively higher flow capacity at high pressure. According to some embodiments, the fluid pressures in the second interior portion 50 of the accumulator assembly 40 may range from approximately 50 to approximately 100 bar and the rate of pressurized fluid flow into the second interior portion 50 may range from 50 liters per minute to 200 liter per minute. Additionally, the pressure of the gas in the first interior portion 48 of the accumulator 50 and in the gas chamber 38 may range from approximately 5 bar to approximately 30 bar during operation.

The control valve assembly 54 could also be configured to fill the second interior portion 50 of the accumulator 40 as quickly as is possible given the flow and pressure limitations of the pump 22. This would allow an operator to almost immediately increase the impact energy produced by the hammer assembly 10 as desired, for example, due to particular working conditions. For instance, the hammer assembly may have an adjustment that allows the length of the stroke of the piston 14 to be shortened to provide a greater frequency of impacts. However, shortening the stroke of the piston 14 decreases the impact force because the piston retracts a shorter distance into the gas chamber 38 thus producing less compression of the gas and less downward pressure on the piston 14. This loss of force produced by the gas chamber may be compensated by using the accumulator assembly 40. In particular, the second interior portion 50 of the accumulator assembly 40 may be filled with sufficient pressurized fluid to compensate for the loss in compression due to the shorter return stroke of the piston 14 by shrinking the available volume in the first interior portion 48. As noted previously, this would reduce the effective volume available for the gas in the gas chamber 38 and thereby increase its pressure and the downward force on the retracting piston 14. In this way, it may be possible to produce the same downward force on the piston 14 despite using a shorter stroke length.

INDUSTRIAL APPLICABILITY

The variable volume accumulator assembly 40 described herein may be implemented in hydraulic hammers of any size or configuration that include a gas chamber for providing at least some of the impact energy for the hammer. For example, the described variable volume accumulator 40 may be implemented on a hydraulic hammer in such a way that that it allows the impact energy produced by the hammer to be selectively and variably increased. This may allow the hammer to be used more in a more versatile manner. For instance, the variable volume accumulator may be used to selectively increase the impact energy when encountering harder materials that are more difficult to break apart. Increasing the impact energy may allow the hammer to break such materials more quickly than if less impact energy was used.

Additionally, the impact energy could be selectively increased using the variable volume accumulator 40 to compensate for a shortening of the stroke of the hammer. Thus, the variable volume accumulator 40 may allow a hammer to produce substantially the same impact force even when the frequency of impacts is increased. This is in contrast to conventional hammer assemblies in which the impact frequency can be increased only by decreasing the impact force.

When breaking softer materials, the variable volume accumulator 40 may be used to selectively lessen the impact energy produced by the hammer. The ability to increase the impact energy produced by the hammer only when needed may help extend the life of the seals associated with the gas chamber 38 particularly as compared to hammers that produce higher impact energy by permanently increasing the charging pressure of the gas chamber.

While the variable volume accumulator assembly 40 is described in connection with an exemplary hammer assembly 10, it also could be implemented in other contexts. In particular, the variable volume accumulator assembly of the present disclosure could be used in any application involving a pressurized fluid system with which it would be desirable to use an accumulator that could absorb a variable volume of pressurized fluid.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A hammer assembly comprising:

a hammer housing;

a work tool movably supported in the hammer housing;

a gas chamber defined in the hammer housing and containing a compressible gas;

an accumulator assembly including an interior space, a barrier dividing the interior space into a first interior portion containing a compressible gas and a second interior portion configured to receive a pressurized fluid, the barrier being configured to be movable in response to changing the amount of pressurized fluid in the second interior portion and such that movement of the barrier varies the volume of the first interior portion, the first interior portion being in communication with the gas chamber;

a control valve assembly configured for selectively placing the second interior portion of the accumulator assembly in communication with a pressurized fluid source; and a piston movably disposed in the housing and having a first fluid engagement surface configured for engagement with a pressurized fluid for moving the piston in a first direction away from the work tool and thereby compressing the compressible gas in the gas chamber and in the first interior portion of the accumulator assembly and producing a biasing force on the piston acting in a second direction towards the work tool, the piston having a second fluid engagement surface configured for engagement with a pressurized fluid for moving the piston in the second direction along with the biasing force.

2. The hammer assembly according to claim 1 wherein the control valve assembly is configured for selectively placing the second interior portion of the accumulator assembly in communication with a low pressure source.

3. The hammer assembly according to claim 2 wherein the control valve assembly includes a first position in which the second interior portion of the accumulator assembly is in communication with the pressurized fluid source and is blocked from communicating with the low pressure source and a second position in which the second interior portion of the accumulator assembly is blocked from communicating with the pressurized fluid source and is in communication with the low pressure source.

4. The hammer assembly according to claim 1 wherein the control valve assembly includes a flow restriction device arranged to restrict the flow of pressurized fluid from the pressurized fluid source to the second interior portion of the accumulator assembly.

5. The hammer assembly according to claim 1 wherein the accumulator assembly includes an accumulator housing that defines the interior space and wherein the accumulator housing is attached to the hammer housing.

6. The hammer assembly according to claim 5 wherein the first interior portion of the accumulator assembly communicates with the gas chamber through a fluid passage in the hammer housing.

7. The hammer assembly according to claim 1 wherein the barrier comprises a rubber membrane.

8. A hammer assembly comprising:

a hammer housing;

a work tool movably supported in the hammer housing;

a gas chamber defined in the hammer housing and containing a compressible gas;

an accumulator assembly including an interior space, a barrier dividing the interior space into a first interior portion containing a compressible gas and a second interior portion configured to receive a pressurized fluid, the barrier being configured to be movable in response to changing the amount of pressurized fluid in the second interior portion and such that movement of the barrier varies the volume of the first interior portion, the first interior portion being in communication with the gas chamber; and a piston movably disposed in the housing, the piston being movable in a first direction away from the work tool to thereby compress the compressible gas in the gas chamber and in the first interior portion of the accumulator assembly producing a biasing force on the piston acting in a second direction towards the work tool, the piston being movable in the second direction, at least in part, in response to the biasing force.

9. The hammer assembly of claim 8 further including a control valve assembly configured for selectively placing the second interior portion of the accumulator assembly in communication with a pressurized fluid source.

10. The hammer assembly according to claim 9 wherein the control valve assembly is configured for selectively placing the second interior portion of the accumulator assembly in communication with a low pressure source.

11. The hammer assembly according to claim 10 wherein the control valve assembly includes a first position in which the second interior portion of the accumulator assembly is in communication with the pressurized fluid source and is blocked from communicating with the low pressure source and a second position in which the second interior portion of the accumulator assembly is blocked from communicating with the pressurized fluid source and is in communication with the low pressure source.

12. The hammer assembly according to claim 10 wherein the control valve assembly includes a flow restriction device arranged to restrict the flow of pressurized fluid from the pressurized fluid source to the second interior portion of the accumulator assembly.

13. The hammer assembly according to claim 8 wherein the accumulator assembly includes an accumulator housing that defines the interior space and wherein the accumulator housing is attached to the hammer housing.

14. The hammer assembly according to claim 8 wherein the barrier comprises a rubber membrane.

* * * * *